US010584457B2

(12) United States Patent
Pasini

(10) Patent No.: US 10,584,457 B2
(45) Date of Patent: Mar. 10, 2020

(54) GUY WIRE SUPPORT ANCHORING DEVICE

(71) Applicant: TDM TECHNOLOGIES INC., Markham (CA)

(72) Inventor: Ciro Pasini, Markham (CA)

(73) Assignee: TDM TECHNOLOGIES INC., Markham, ON (CA)

( * ) Notice: Subject to any disclaimer, the term of this patent is extended or adjusted under 35 U.S.C. 154(b) by 0 days.

(21) Appl. No.: 15/779,515

(22) PCT Filed: Nov. 25, 2016

(86) PCT No.: PCT/CA2016/000292

§ 371 (c)(1),
(2) Date: May 26, 2018

(87) PCT Pub. No.: WO2017/088042

PCT Pub. Date: Jun. 1, 2017

(65) Prior Publication Data

US 2018/0347138 A1 Dec. 6, 2018

Related U.S. Application Data

(60) Provisional application No. 62/260,384, filed on Nov. 27, 2015.

(51) Int. Cl.
*E04H 12/20* (2006.01)
*E02D 5/80* (2006.01)

(52) U.S. Cl.
CPC ..... *E02D 5/805* (2013.01); *E04H 12/20* (2013.01)

(58) Field of Classification Search
CPC ..... E04G 9/083; E02D 5/805; E04H 12/20; B65D 5/56; B65D 5/10; B65D 5/4266; B65D 5/36
See application file for complete search history.

(56) References Cited

U.S. PATENT DOCUMENTS 3,148,444 A * 9/1964 Stark ..... E04B 5/326 29/455.1
3,152,668 A 10/1964 Smith
(Continued)

OTHER PUBLICATIONS

International Search Report and Written Opinion in PCT/CA2016/000292 dated Feb. 20, 2017.

*Primary Examiner* — Beth A Stephan
(74) *Attorney, Agent, or Firm* — Manelli Selter PLLC; Edward Stemberger

(57) ABSTRACT

A guy wire anchoring device is provided which can be used to hold a tower in place. The device features a container which has a plurality of solid side panels, which are connected to two adjacent side panels using a side hinge mechanism. As a result, the container can be reversably moved from an essentially flat, folded orientation, to an expanded empty container orientation when un-folded. The container also includes at least one base plate which is hingeably mounted to the lower edge of at least one side panel of the container, and which can be moved to a position wherein it at least partially closes the opening at the bottom of said empty container. The container is adapted to be filled with a suitable, local material such as sand, aggregate, or the like, in order to increase the weight of the guy wire anchoring device. The device includes a guy wire anchoring bracket to which guy wires can be attached. The device is easily stored, and can be easily transported to the tower location for use as a guy wire anchoring device.

19 Claims, 7 Drawing Sheets

(56) References Cited

U.S. PATENT DOCUMENTS 3,994,108 A * 11/1976 Johnson ..... E04H 5/12 52/247
4,776,140 A 10/1988 Wight et al.
4,850,506 A * 7/1989 Heaps, Jr. ..... B65D 77/061 229/117.3
5,307,982 A * 5/1994 Swindell ..... B65D 5/46024 229/117.19
5,531,419 A * 7/1996 Gustafsson ..... E04H 12/187 248/519
5,570,834 A * 11/1996 Larson ..... A45F 3/02 224/601
5,630,543 A * 5/1997 Dugan ..... B65D 5/3628 229/109
5,735,429 A * 4/1998 Whitworth ..... B65D 77/042 229/122.21
6,386,437 B1 * 5/2002 Larson, Jr. ..... B65D 5/3621 229/109
6,827,217 B2 * 12/2004 Matsuguchi ..... B65D 85/04 206/395
7,089,705 B1 * 8/2006 Lieberman ..... E04H 12/187 248/670
7,796,093 B1 * 9/2010 Scott ..... H01Q 1/1242 343/874
8,312,680 B2 * 11/2012 Krahn ..... E02D 5/80 52/148
9,499,954 B2 * 11/2016 Shi ..... E02D 27/42
2002/0028716 A1 * 3/2002 Gormley ..... E04H 12/2246 473/423
2004/0056169 A1 * 3/2004 Harbaugh ..... E04H 12/2246 248/519
2008/0035831 A1 * 2/2008 Rodin ..... E02D 27/42 249/25
2012/0011780 A1 1/2012 Reyes et al.
2013/0146740 A1 * 6/2013 Ma ..... F16M 13/00 248/519
2014/0059957 A1 * 3/2014 Stark ..... E02D 27/42 52/292
2015/0200619 A1 * 7/2015 Worden ..... H02S 20/10 136/251
2017/0159318 A1 * 6/2017 Cusson ..... E02D 27/08
2017/0244234 A1 * 8/2017 Behr ..... E04H 12/08

* cited by examiner

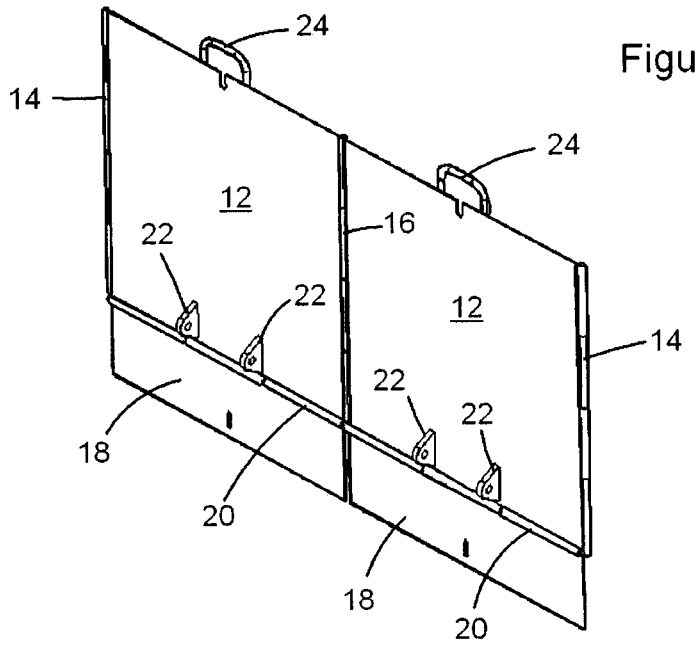
Figure 3
Figure 4
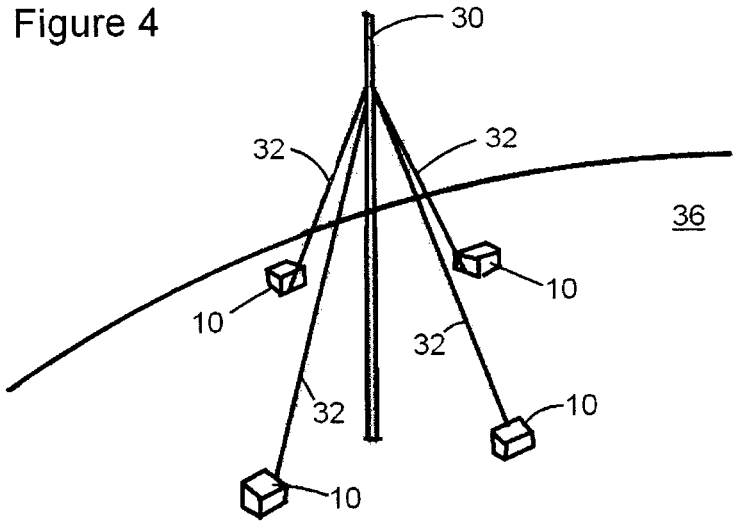

GUY WIRE SUPPORT ANCHORING DEVICE

FIELD OF THE INVENTION

The present invention relates to the field of guy wire anchoring systems, and in particular, relates to a guy wire anchoring device that can be rapidly positioned and installed, and which uses local materials, such as local sand, aggregate or the like, for added weight, in order to hold the device in place.

BACKGROUND OF THE INVENTION

Towers, including for example, power or cable transmission support towers, utility poles, radio antennae, microwave transmission towers, or the like, are commonly supported by guy wires that are connected to the tower at one end, and anchored at the other end. Typically, the guy wires are anchored to the ground using an anchoring device, and a wide variety of guy wire anchoring devices are commonly used.

For example, ground anchors such as screw anchors that are screwed into solid ground or rock, or anchors that are set in concrete after drilling into a solid object, are commonly employed. Other temporary anchors can include arrangements such as deadman anchors or sulfur anchors.

However, in sandy soils, or in sand itself, the use of these types of anchoring devices that are screwed or cemented into the ground is not normally practical since the sand cannot provide the requisite tension to hold the guy wire in position. In fact, if used in these environments, the anchor is usually easily removed from the sand, and/or will ultimately become loose, as the sand shifts or moves. As a result, the tower will be left unsupported.

In these cases other approaches have been used to anchor the tower by, for example, connecting the guy wire to a heavy object. These heavy objects can include heavy construction vehicles, or the like, on a temporary basis, or to one or a collection of, rocks or concrete blocks that can be dropped into place near the tower. Other approaches include used of weighted wire gabions that have been filled with rocks or earth. However, these approaches require the gabions and weighted materials (rocks, earth etc.) to be transported to the tower site.

As such, it would be beneficial to provide a guy wire anchoring system which can be more easily transported to the tower site, and employed using materials local to the tower.

SUMMARY OF THE INVENTION

It is therefore an advantage of the present invention to provide a guy wire anchoring device, which eliminates or ameliorates, for all practical purposes, the above-mentioned limitations.

It is a further advantage of the present invention to provide a guy wire anchor which is easily transportable.

It is a still further advantage of the present invention to provide an anchor which can be collapsed, when not in use, and requires minimal space during storage or transport.

It is a yet still further advantage of the present invention to provide an anchor which can be reused.

It is an even yet still further advantage of the present invention to provide an anchor which is suitable for a variety of structural loading uses and a variety of soil and terrain conditions, and in particular, an anchor which is adapted for use in sand.

These and other advantages are achieved in an anchor which, in one embodiment, comprises a preferably box shaped container having a plurality of solid side panels, each connected to the other by hinge mechanisms at each side edge of the side panel, and which hinge mechanisms allow the container to be collapsed to an essentially flat, folded orientation, or expanded to form an empty, preferably box-shaped container when un-folded.

At the bottom of the container, the anchor also preferably comprises one or more base plates hingeably mounted to the lower edge of at least one side panel of the anchor, using a further hinge mechanism. More preferably, at least two base plates are attached to the box container, on at least one set of opposite sides. Most preferably, a plurality of base plates are hingeably attached to the bottom of the container, along each container side panel.

The container also preferably includes a guy wire attachment bracket, preferably located on at least one side of the container, to which a guy wire can be attached.

Accordingly, in a first aspect, the present invention provides a guy wire anchor comprising a container having solid side panels, with hinge mechanisms at each corner of the container, which hinge mechanisms allow the container to be collapsed to an essentially flat, folded orientation, and expanded to form a box-shaped container when un-folded, and preferably additionally comprises one or more base plates hingeably mounted to the lower edge of at least one side panel of the anchor, using a further hinge mechanism; and at least one guy wire attachment bracket affixed to the container, preferably on at least one side panel, to which a guy wire can be attached.

The container will preferably have four sides so as to form a rectangular, or more typically, a square shape, when unfolded. The number of sides can vary however. Generally, the number of sides is between 3 and 10. Preferably, however, the number of sides is an even number, between 4 and 8, and most preferably the number of side panels is 4 or 6.

During storage and shipping the side panels of the container are hingeably rotated using the hinge mechanisms, so that the container can be folded into an essentially flat orientation. To achieve this, preferably, the container comprises an even number of sides, and the container is essentially symmetrical through at least one axis, which axis also passes through opposing sets of hinge mechanisms.

Preferably, the base plates are positioned so as to be co-planar with, and extending from the side panels. As such, when flat, the base plates extend from, but are in the same plane as the side panels. The base plate or plates, can have any suitable size or shape. When unfolded, and rotated inward to the inside of the container, the base plates will at least partially cover the opening at the bottom of the container. In one preferred embodiment, the base plates can be sized so as to completely close the bottom of the container, when unfolded into place, in an unfolded container. The base plates can overlap, one with the other, or can positioned so as to be adjacent to each other, in the unfolded position.

For example, for a four sided square container, the base plates can be rectangular and overlap one with the other, in the unfolded position. Alternatively, the base plates can be triangular, or be a truncated triangle, so that the sides of the base plates will be adjacent one to the other, in the unfolded position.

Once unfolded, the container provides a open vessel which can be filled with any suitable material to weight the container down, and aid in holding it in place. As such, the weighted container can act to act as an anchor for a tower guy wire.

In applications where the tower is placed in a sandy environment, the container can be unfolded in its desired location, and then filled with sand, stones, rocks, dirt, aggregate, and the like, or any suitable local material. Most preferably however, the container would be filled with sand. The container is adapted to be placed on top of the ground or sand, or the container can be fully or partially buried into the ground or sand.

An optional cover, of any suitable material can be used to hold the sand, or other material, in the container, after the container has been filled.

Attached to the container are one or more guy wire attachment brackets, to which, one or more guy wires can be attached. The wire attachment brackets can be positioned at any suitable position, but preferably, these are located at or near the lower edge of the container sides.

Lifting hooks can also be provided on the container, which lifting hooks are preferably located at or near the upper edge of the container sides.

The container, brackets and hooks can be manufactured from any suitable materials which will be able to hold the sand, or the like, inside of the container. These materials can include wood or plastic, but most preferably, the container is fabricated from a sheet metal, including for example, aluminum or iron. Most preferably though, the container, and related parts, are manufactured from steel.

The container sides, and base plates, are preferably made from the same materials as each other, and may, or may not, be coated with other materials to assist in preventing degradation of the container.

The size of the container used can vary depending of the desired volume of the container when unfolded. Preferably, each side of the container has a width or height of between 0.5 and 3 meters, and more preferably, each side of the container has a width or height of between 1 and 1.5 meters. For a square container, having four sides each with a width and height of 1.2 meter, a container volume of 1.728 $m^3$ is provided. This volume can be filled with sand, aggregate, or any other suitable material.

As an example, for sand having a density of 1600 $kg/m^3$, a 1.728 $m^3$ container would hold roughly 2765 kg of sand. However, the container can be selected from a variety of different sized containers, and thus provide the volume that will provide the desired weight of sand or aggregate that is needed in order to maintain tension on the tower guy wires. Normally, multiple containers will be used around the tower, and if desired, multiple containers can also be used in at given location around the tower. In particular, two or more container can be located adjacent to one another, on top of one another, and/or connected to each other, in order to increase the total weight of the containers, at any given location.

In the folded position, the flattened container will have a width of approximately double the width of the unfolded container, and a height equal to the combined height of the side of the container and the base plate. Thus, for the container discussed hereinabove, the folded container will have a width of 2.4 m, and a height of 1.2 m plus the height from the base plate. However, the depth of the folded container is essentially merely twice the thickness of the container sides. As such, in the folded position, a number of containers can be placed in a relatively small area.

In another option, the base plates can be folded inwards towards the center of the container, and rest against the inner surface of the side panel, which side panel may or may not be formed so as to provide an inset area in which the base plate will fit. This option further reduces the height of the container, in the folded position. Alternatively, the base plates can be folded outwardly so as to be folded flat against the outside of the side panel Again, this option will also reduce the height of the container, in the folded position.

Because of their relatively small shape when folded flat, a relatively large number of folded containers can be shipped in a smaller truck, or the like. Further, since the containers are shipped without the weight used to hold the container in place, transportation of the container is greatly facilitated over other systems, such as concrete blocks or the like, which are pre-assembled or manufactured prior to being shipped to the tower location.

DETAILED DESCRIPTION OF THE INVENTION

In the present application, the term "tower" is used in a general sense, and can refer to any structure to which guy wires would be attached. While towers such as power transmission towers are typical of one intended use of the present invention, the use of the containers described herein is not limited to only this application.

Moreover, the term "container" is also used in a general sense, and the containers of the present invention can be any suitable shape of size. While square or rectangular shaped containers are most preferred, other shapes such as triangular, hexagonal, octagonal, and the like, are not excluded.

Also, as indicated above, while the material used to fill the container is commonly sand, the use of other materials is not excluded. These other filling materials can include, for example, dirt, stones rocks, aggregates, and the like, or any combination of these materials. However, the use of other suitable materials is not excluded by this listing.

BRIEF DESCRIPTION OF THE DRAWINGS

Embodiments of this invention will now be described by way of example only in association with the accompanying drawings in which:

FIG. 3 is a perspective view of the guy wire anchoring device of FIGS. 1 and 2, in a completely folded position;

FIG. 4 is a view showing a tower with a plurality of guy wire anchoring devices located around the tower;

DETAILED DESCRIPTION OF THE PREFERRED EMBODIMENTS

Figure 1:
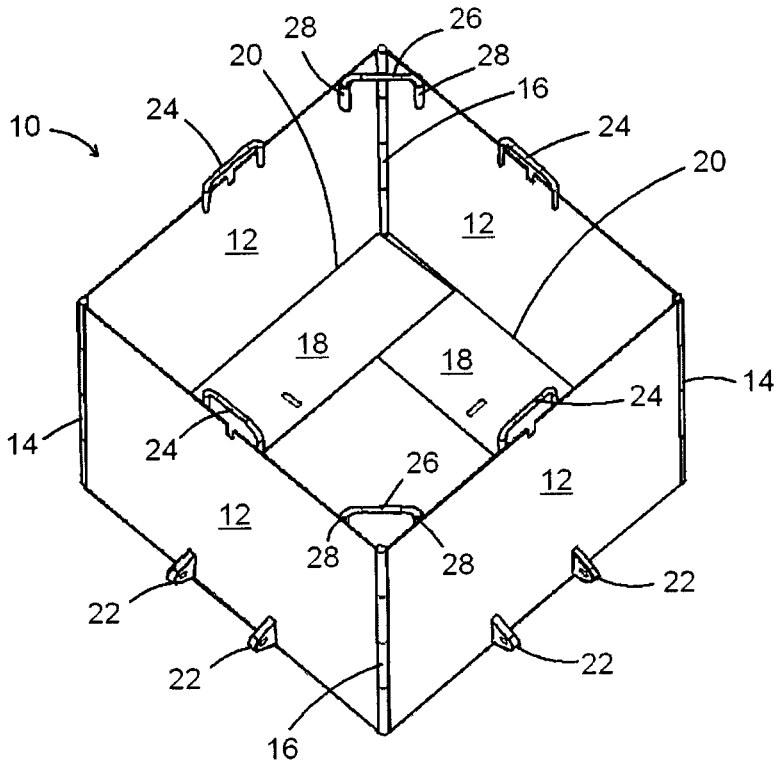
FIG. 1 is a perspective view of a guy wire anchoring device of the present invention, in an unfolded orientation.

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements.

It is expressly understood, however, that the drawings are for the purpose of illustration and description only and are not intended as a definition of the limits of the invention. Also, unless otherwise specifically noted, all of the features described herein may be combined with any of the above aspects, in any combination.

Referring to FIG. 1, a guy wire anchoring device 10, is shown in a completely unfolded position, and ready for use as an anchoring device. Anchoring device 10 is square shaped, having four sides 12. Each side has a width of 2 meters, and a height of 1 meter, and thus provides a container volume of 4 $m^3$. On a first set of opposite corners, where sides 12 intersect with one another, side hinges 14 which move over an angle of 0 to 90°, are provided. On the other corners where sides 12 insert, side hinges 16 are provided which move over an angle of 90 to 180°.

At the bottom edge of each of side panels 12 are base plates 18, which base plates 18 are connected to each of sides 12 by bottom hinges 20. Bottom hinges 20 move over an angle of from 90 to 180°.

In FIG. 1, base plates 18 are rectangular in shape, and have a width of 2 meters, and a height of 0.5 meters. In the unfolded container orientation shown in FIG. 1, base plates 18 overlap, one with the other.

At the bottom edge of each of sides 12 are guy wire anchoring brackets 22. Two of these brackets 22 are shown on each side, but more or fewer brackets can be used.

Lifting hooks 24 are also positioned at the top of sides 12, and these hooks 24 can be used to lift anchoring device 10. Once lifted, completely unfolded anchor device 10 can be moved to a suitable position, and then it can be filled with sand.

For the 4 $m^3$ device shown in FIG. 1, up to 6.4 tonnes of sand can be used to fill the container.

Anchor device 10 also includes a locking device that includes a "C"-shaped locking pin 26 which is adapted to fit into tubes 28 on the inner surfaces of sides 12. When pin 26 is inserted into tubes 28 (on adjacent side panels 12), the sides 12 of device 10 are locked into position.

Figure 2:
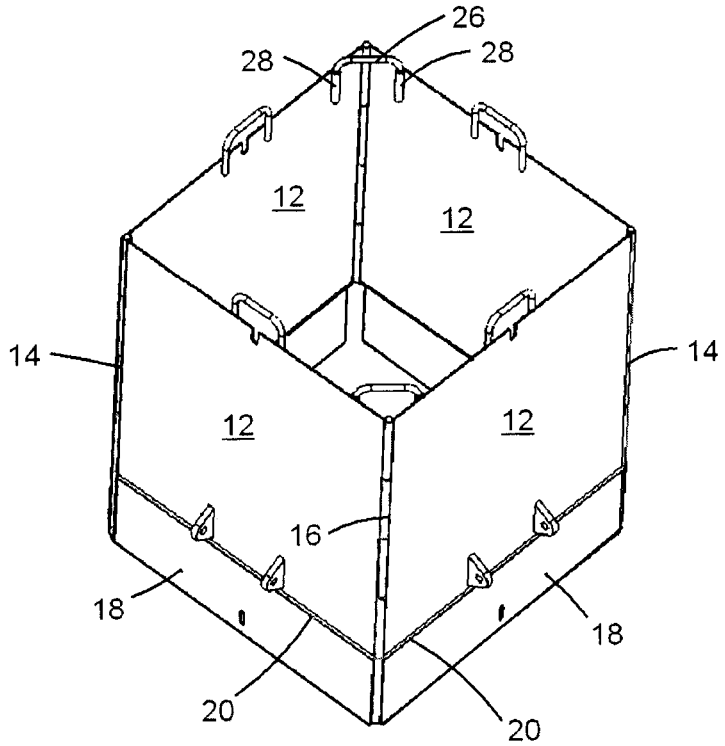
FIG. 2 is a perspective view of the guy wire anchoring device of FIG. 1, in a partially folded orientation.

In FIGS. 2 and 3, the same guy wire anchoring device as shown in FIG. 1, is shown in partially folded (FIG. 2) and completely folded (FIG. 3) positions. In partially folded orientation (FIG. 2), pins 26 have been removed, and base plates 18 have been rotated using bottom hinges 20, and are now coplanar with sides 12.

In FIG. 3, side panels 12 have been completely folded, using hinges 14 and 16, so that side panels 12 are now adjacent to one another. After making these folds, device 10 is essentially flat, as seen in FIG. 3, and has a width of 4 meters, and a height of 1.5 meters. For a side panel thickness of 2.5 cm, the thickness of folded container 10, in FIG. 3, would be approximately 5 cm. In this configuration, container 10 and can be easily stored or transported.

In FIG. 4, a tower 30 is shown in a vertical position in a sandy area 36. Around tower 30 are four anchoring device 10, as shown in FIG. 1. Tower 30 is connected to anchoring devices 10 by four guy wires 32. Each of anchoring devices 10 is filled with 6 tonnes of sand that act to hold tower 30 in position.

Anchoring devices 10 can be used on a permanent basis, or on a temporary basis. Once the anchoring devices are no longer needed, the sand can be removed from the anchoring device 10, and the device can be folded into the orientation shown in FIG. 3.

It should also be noted that when devices 10 are used, the open top of each device can be covered by a cover (not shown). The cover can be provided using any convenient means, including a flexible tarp or the like, or a more rigid cover such as a cover made of metal, plastic, wood, or the like. This cover aids in ensuring that the sand is not accidentally or inadvertently removed from devices 10 by, for example, wind or rain.

Figure 5:
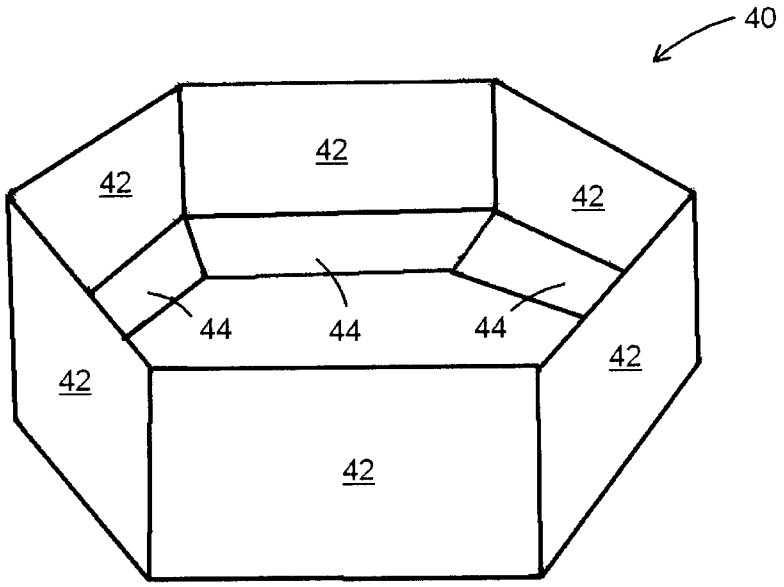
FIG. 5 is a perspective view of a further embodiment of the present invention, in an unfolded orientation.

In FIG. 5, a further embodiment of the present invention is shown wherein container 40 has six side panels 42, and six base panels 44, and thus forms a hexagon shaped container. Each of side panels 42 has a width of 1.2 meters, and a height of 1 meter. Base panels 44 have a height of 0.5 meters, and a proximate edge width of 1.2 meters at a location adjacent to side panels 42, to a width of 0.6 meters at their distal edge. Thus, the sides of side panels 42 angle inward at an angle of approximately 60°. In the unfolded configuration in FIG. 5, base panels 42 do not overlap, one with the other, but the edges of the base panels rest roughly adjacent to one another.

Figure 6:
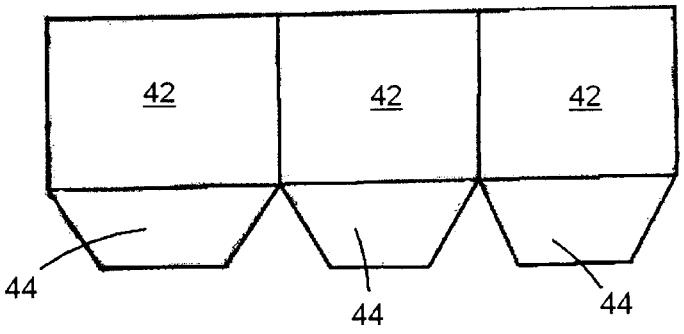
FIG. 6 is a perspective view of the guy wire anchoring device of FIG. 5, in a completely folded position.

In FIG. 6, container 40 is shown in its folded position, and has an overall width of 3.6 meters, and a height of 1.5 meters.

Figure 7:
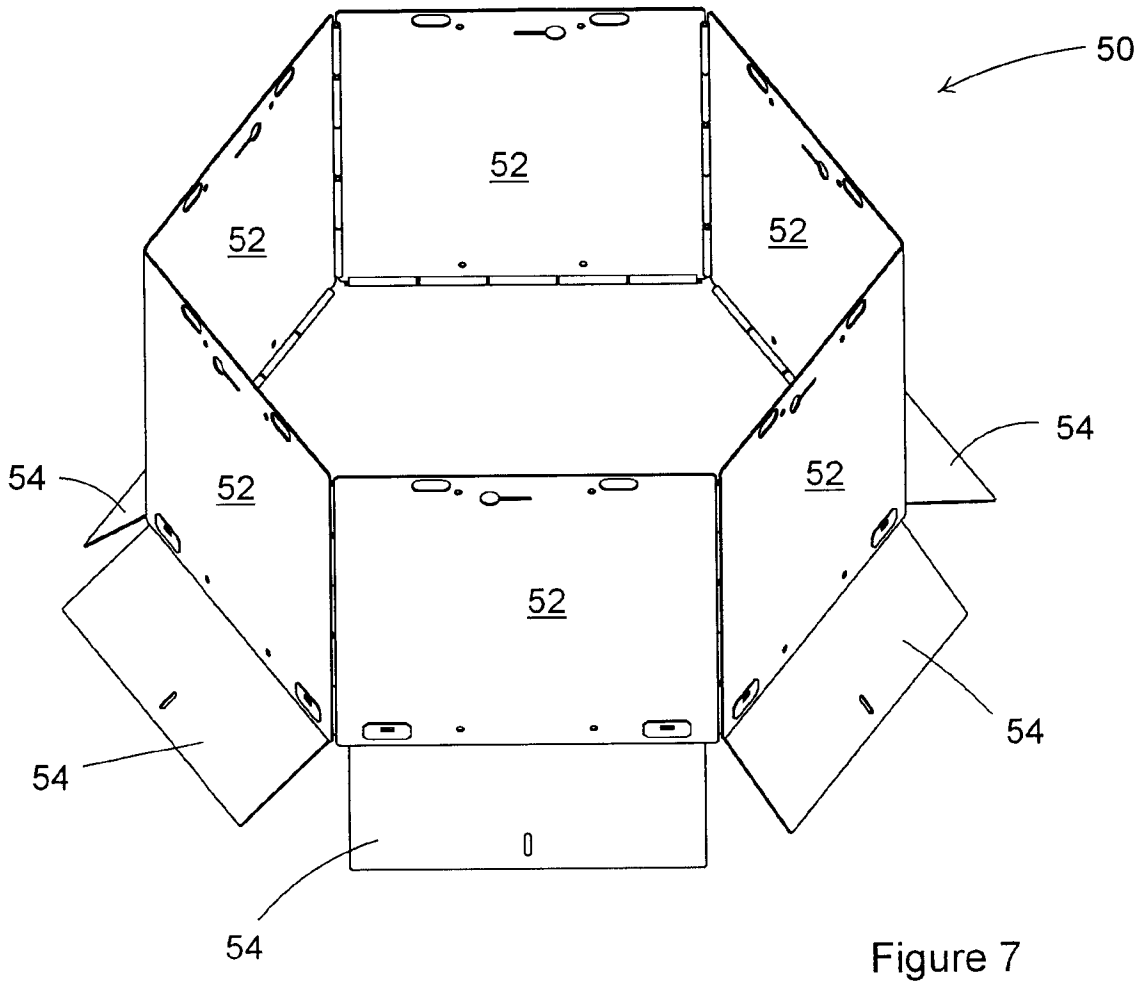
FIG. 7 is a perspective view of a still further embodiment of the present invention, in an unfolded orientation.

In FIG. 7, a further embodiment of a hexagonal container 50 is shown having side panels 52 of similar size to those shown in FIGS. 5 and 6. Base panels 54 however, are rectangular, and thus, in the unfolded position, base panels 54 will overlap with each other.

Figure 8:
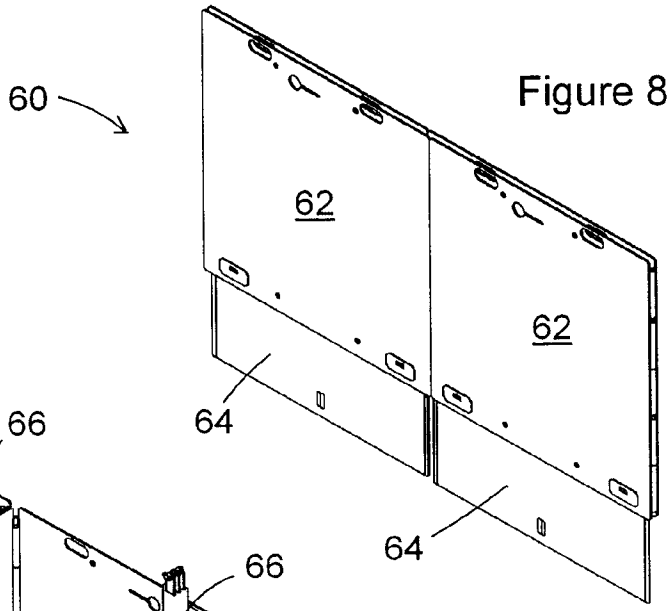
FIG. 8 is a perspective view of a yet still further embodiment of the present invention, in a folded orientation.
Figure 9:
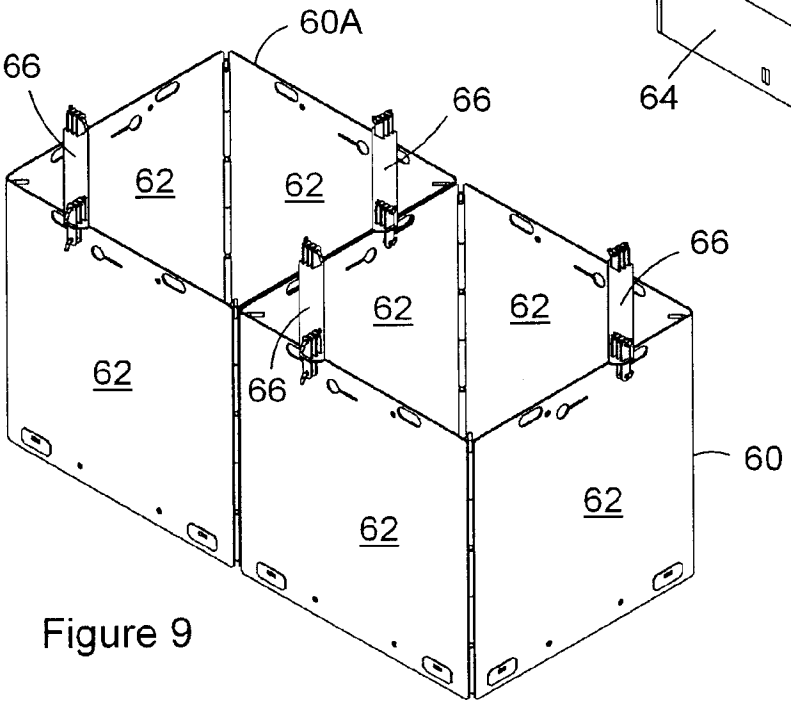
FIG. 9 is a perspective view of two anchors shown in a side-by-side orientation.

In FIG. 8, a further embodiment of a square anchor device 60 is shown in a folded orientation. Device 60 has side panels 62 and base panels 64. In FIG. 9, two of these anchoring devices 60 and 60A, are shown in an unfolded orientation, and positioned adjacent to each other, on one side. External clips 66 are used to lock side panels 62 in position, by clipping onto the corners of side panels 62.

External clips 66 also act to lock adjacent anchoring devices 60 to each other, by clipping two side panels 62 to each other.

Figure 10:
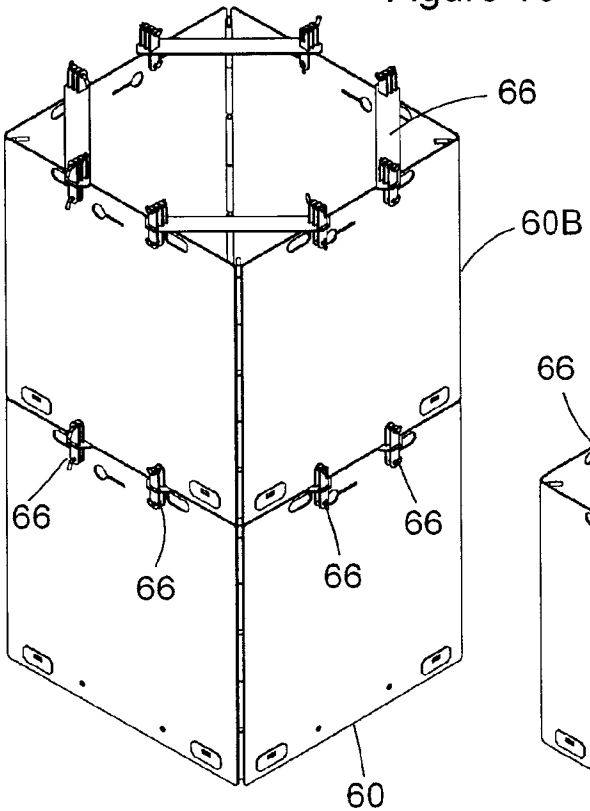
FIG. 10 is a perspective view of two anchors, shown with one anchor atop of another.

In FIG. 10, four external clips 66 can be used at each corner of anchoring device 60, and thus act as a platform on which a second anchoring device 60 can be placed. This allows a first anchoring device 60 to be used as a support for a second anchoring device 60B. Clips 66 on the top of second anchoring device 60B can be used to lock the corners of anchoring device 60B in place, or can also be used as a support for a third anchoring device.

Figure 11:
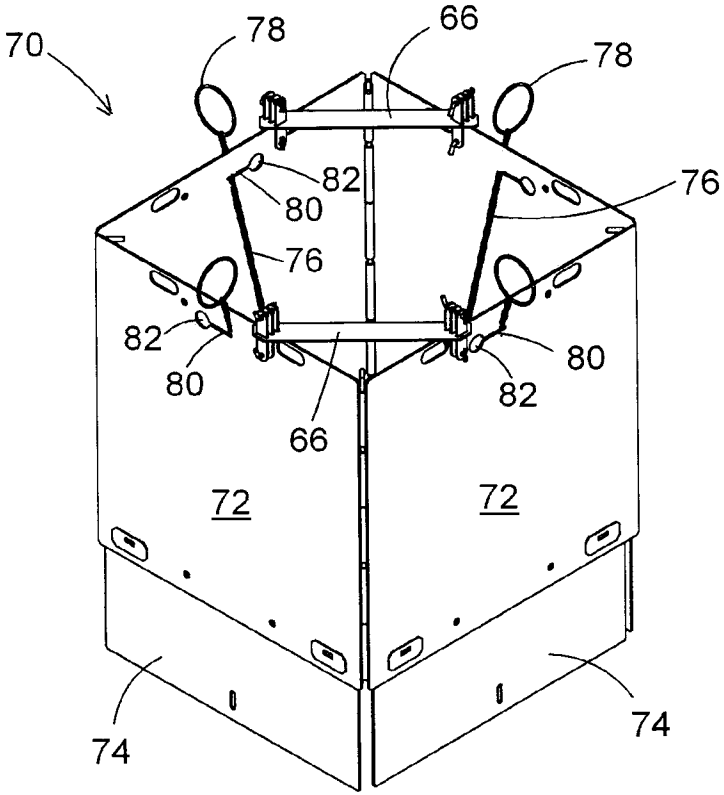
FIG. 11 is a perspective view of the embodiment shown in FIG. 8, in a partially unfolded orientation.

In FIG. 11, anchoring device 70 is shown in a partially unfolded position, wherein side panels 72 have been separated from each other, but base panels 74 still extend straight downward. Clips 66 have been inserted to lock side panels 72 in position. In this embodiment, however, one end of a link chain 76, with a handle 78 at the opposite end, is attached to the inside of each base panel 74. Link chain 76 extends from base panel 74 upwards through a slot 80 located near the top of side panels 72.

In operation, link chains 76 are moved to the opening 82 at the end of each slot 80, so that the link chains 76 can be pulled using handles 78. This raises base panels 74 into their operative position. Once base panels 74 have been raised into position, link chains 76 can be slid into slots 80, which locks link chains 76 in position. As such, base panels 74 are locked into position, as is shown in FIG. 12.

Figure 12:
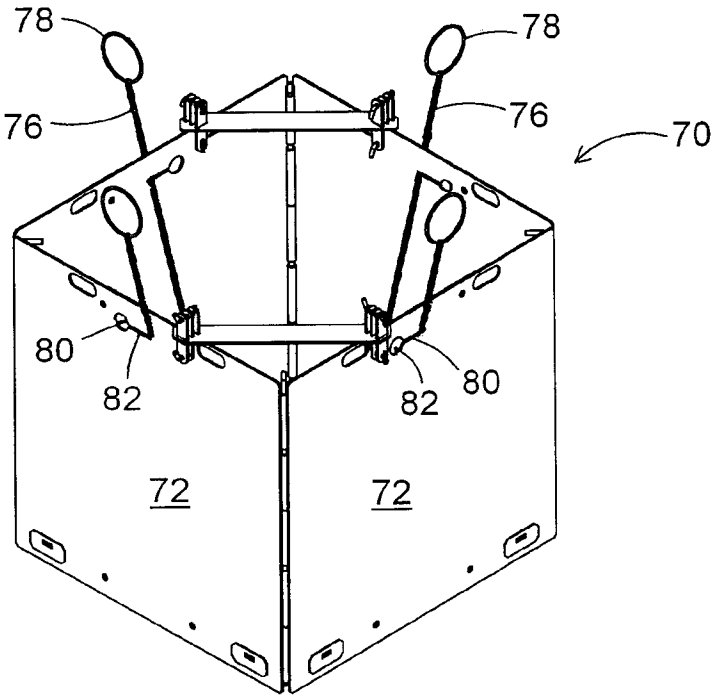
FIG. 12 is a perspective view of the embodiment of FIGS. 8 and 9, in a fully unfolded orientation.
Figure 13:
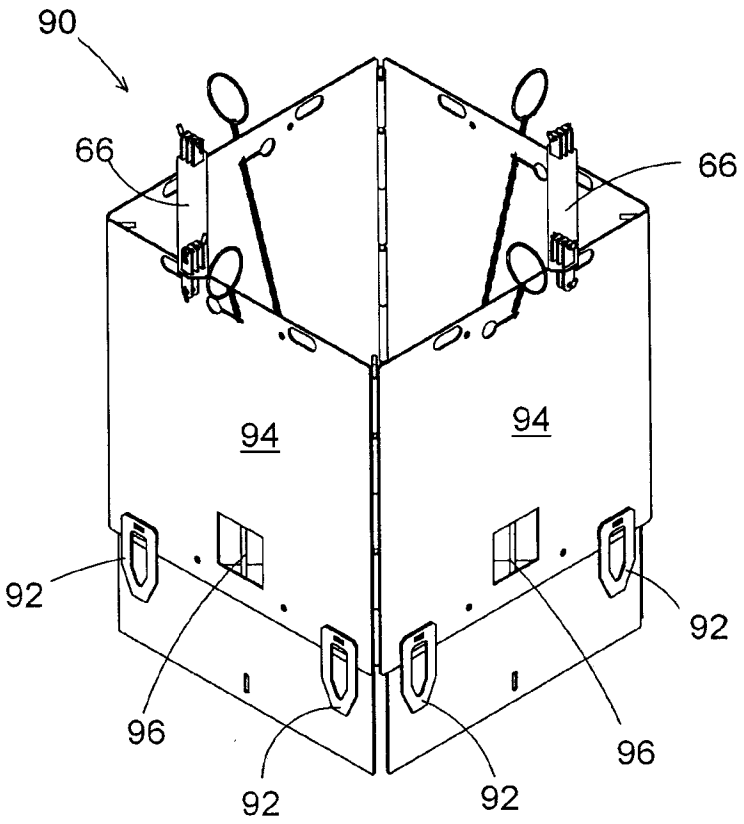
FIG. 13 is a perspective view of another embodiment of the present invention in a partially unfolded orientation.
Figure 14:
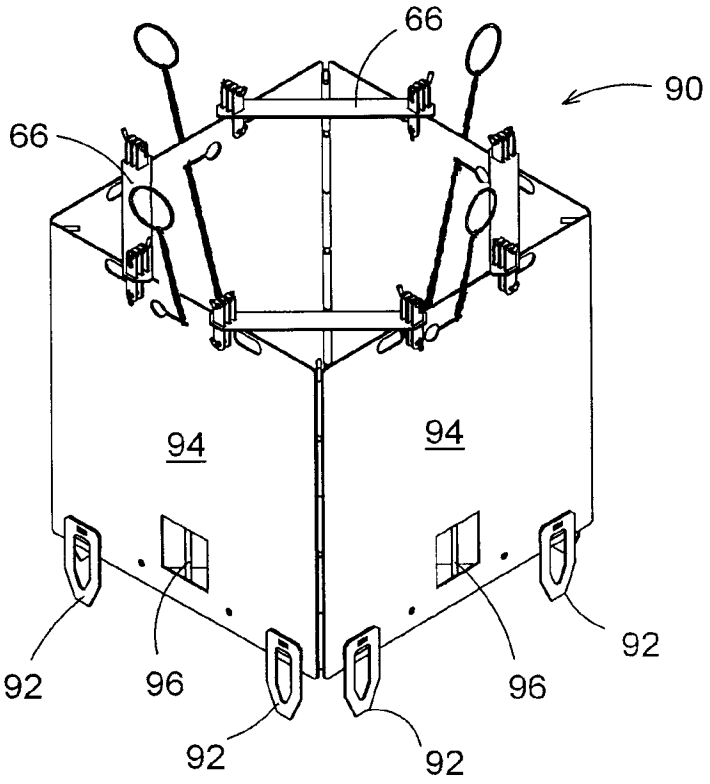
FIG. 14 is a perspective view of the anchor shown in FIG. 13, in a fully unfolded orientation.

In FIGS. 13 and 14, the same design and chain operation as shown in FIGS. 11 and 12 is provided. In this case, however, anchoring device 90 includes "teeth" 92 at the bottom of each side panel 94, and teeth 92 are designed to dig into the soil or sand when anchoring device 90 is put into place. Teeth 92 can be any suitable size or shape, but in the embodiment shown, teeth 92 extend 10 to 15 cm below the lower edge of side panels 94. Also, a different attachment point 96 is shown, which attachment point 96 is essentially flush with side panels 94. This eliminates the protrusion of the attachment point outward from the sides of side panels, as shown in FIGS. 1 to 3.

Thus, it is apparent that there has been provided, in accordance with the present invention, a guy wire anchoring device which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps. Further, the invention illustratively disclosed herein suitably may be practised in the absence of any element which is not specifically disclosed herein.

Moreover, words such as "substantially" or "essentially", when used with an adjective or adverb is intended to enhance the scope of the particular characteristic; e.g., substantially planar is intended to mean planar, nearly planar and/or exhibiting characteristics associated with a planar element.

Further, use of the terms "he", "him", or "his", is not intended to be specifically directed to persons of the masculine gender, and could easily be read as "she", "her", or "hers", respectively.

Also, while this discussion has addressed prior art known to the inventor, it is not an admission that all art discussed is citable against the present application.

What is claimed is:

1. A tower system comprising a tower, one or a plurality of guy wires attached at one end to said tower and attached at an opposite end thereof to at least one guy wire anchoring device, wherein said at least one of the guy wire anchoring devices for holding said tower in place, comprise a container having:

a plurality of solid side panels each of the side panels having two side edges, and a side hinge mechanism at each of the side edges thereof, each of the side hinge mechanism hingeably connects each of said side panels to two of the side panels, whereby said side hinge mechanisms allow the container to be reversably moved from an essentially flat, folded orientation, to an expanded empty container orientation when un-folded;

one or more base plates hingeably mounted to a lower edge of at least one of the side panels of the container using a lower hinge mechanism; and a guy wire attachment bracket on at least one of the side panels or base plates, to which a guy wire can be attached, wherein said container is adapted to be filled with a suitable material to increase the weight of the guy wire anchoring device, when said container is in said empty container orientation, and wherein said container has been filled with a suitable material.

2. A tower system as claimed in claim 1 comprising multiple guy wire anchoring devices located around the tower.

3. A tower system as claimed in claim 2 wherein two or more of the containers are located adjacent to one another, and/or connected to each other, in order to increase the total weight of the containers, at any given location.

4. A tower system as claimed in claim 1 wherein said container has between 3 and 10 side panels.

5. A tower system as claimed in claim 1 wherein said container has between 4 and 8 side panels.

6. A tower system as claimed in claim 1 wherein said container has 4 or 6 side panels.

7. A tower system as claimed in claim 1 wherein said container, in said empty container orientation, has a rectangular, square or hexagon shape.

8. A tower system as claimed in claim 1 wherein said container, in said empty container orientation, has an even number of sides, and said container is essentially symmetrical through at least one axis, in said empty container orientation.

9. A tower system as claimed in claim 8 wherein said container, in said empty container orientation, is essentially symmetrical through at least one axis and the at least one axis passes through an opposing set of side hinge mechanisms.

10. A tower system as claimed in claim 1 wherein said container has at least two base plates hingeably attached to the lower edge of at least two of the side panels, and which base plates are located on opposite sides of said container, in said empty container orientation.

11. A tower system as claimed in claim 1 wherein said container has a plurality of base plates which are hingeably attached to the lower edge of each of the side panels.

12. A tower system as claimed in claim 11 wherein said base plates are positioned so as to be co-planar with, and extending from said side panels, when said container is in the essentially flat, folded orientation.

13. A tower system as claimed in claim 12 wherein said base plates at least partially cover an opening at a bottom of the container, when said container is in the unfolded, empty container orientation.

14. A tower system as claimed in claim 13 wherein said base plates overlap, one with the other, or are adjacent, one with the other, in the unfolded, empty container orientation.

15. A tower system as claimed in claim 1 wherein said suitable material is a material local to said tower.

16. A tower system as claimed in claim 15 wherein said suitable material is sand, stones, rocks, dirt, aggregate, or combination thereof.

17. A tower system as claimed in claim 1 wherein said container additionally comprises lifting hooks at or near an upper edge of said container side panels.

18. A tower system as claimed in claim 1 wherein said side panels of said container have a width or height of between 0.5 and 3 meters.

19. A tower system as claimed in claim 1 wherein said side panels of said container have a width or height of between 1 and 1.5 meters.

* * * * *